US009692191B2

(12) United States Patent
Tatzel et al.

(10) Patent No.: US 9,692,191 B2
(45) Date of Patent: Jun. 27, 2017

(54) CONTACT ELEMENT WITH RESILIENTLY MOUNTING CONTACT POINTS

(71) Applicant: ROSENBERGER HOCHFREQUENZTECHNIK GMBH & CO. KG, Fridolfing (DE)

(72) Inventors: Frank Tatzel, Ostermiething (AT); Georg Schiele, Waging (DE); Steffen Thies, Überackern (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 14/416,660

(22) PCT Filed: Jul. 8, 2013

(86) PCT No.: PCT/EP2013/002008
§ 371 (c)(1),
(2) Date: Jan. 23, 2015

(87) PCT Pub. No.: WO2014/015944
PCT Pub. Date: Jan. 30, 2014

(65) Prior Publication Data

US 2015/0180182 A1 Jun. 25, 2015

(30) Foreign Application Priority Data

Jul. 25, 2012 (DE) ..... 20 2012 007 216 U

(51) Int. Cl.
*H01R 9/05* (2006.01)
*H01R 24/40* (2011.01)
*H01R 13/24* (2006.01)
*H01R 24/50* (2011.01)
*H01R 103/00* (2006.01)

(52) U.S. Cl.
CPC ..... *H01R 24/40* (2013.01); *H01R 13/24* (2013.01); *H01R 13/2407* (2013.01); *H01R 24/50* (2013.01); *H01R 2103/00* (2013.01)

(58) Field of Classification Search
CPC .... H01R 24/40; H01R 13/24; H01R 13/2407; H01R 24/50; H01R 2103/00
USPC ..... 439/578, 584, 859, 609, 851, 667, 775
See application file for complete search history.

(56) References Cited

U.S. PATENT DOCUMENTS 4,588,241 A 5/1986 Ardezzone
4,850,893 A 7/1989 Williams
4,892,491 A * 1/1990 Budano, II ..... H01R 24/44 439/578

(Continued)

FOREIGN PATENT DOCUMENTS

CN 101288206 10/2008
CN 102027644 4/2011

(Continued)

*Primary Examiner* — Tulsidas C Patel
*Assistant Examiner* — Peter G Leigh
(74) *Attorney, Agent, or Firm* — DeLio, Peterson & Curcio LLC; Robert Curcio

(57) ABSTRACT

A contact element having an outer conductor and an inner conductor, which is arranged within the outer conductor, wherein the outer conductor has, in one of its longitudinally axial end faces, at least one contact point for a contact with a contact point on a component part with which contact is to be made. In this case, the contact point is mounted in a spring-like manner.

7 Claims, 6 Drawing Sheets

(56) References Cited

U.S. PATENT DOCUMENTS 5,982,187 A 11/1999 Tarzwell
8,075,338 B1 * 12/2011 Montena ..... H01R 9/0524 439/578
8,079,860 B1 * 12/2011 Zraik ..... H01R 13/207 439/255
8,167,635 B1 * 5/2012 Mathews ..... H01R 13/5205 439/277
8,348,697 B2 * 1/2013 Zraik ..... H01R 13/502 439/321
8,366,481 B2 * 2/2013 Ehret ..... H01R 9/05 439/578
8,506,325 B2 * 8/2013 Malloy ..... H01R 13/187 439/578
8,573,996 B2 * 11/2013 Amidon ..... H01R 9/0524 439/322
8,882,520 B2 * 11/2014 Youtsey ..... H01R 4/26 439/157
8,888,526 B2 * 11/2014 Burris ..... H01R 13/6581 439/578
8,920,892 B2 * 12/2014 Hernandez ..... B65D 1/265 428/34.1
2002/0050388 A1 5/2002 Simpson
2007/0004238 A1 * 1/2007 Breinlinger ..... H01R 13/2407 439/63
2010/0081321 A1 * 4/2010 Malloy ..... H01R 13/187 439/578
2010/0112854 A1 * 5/2010 Bourgeas ..... H01R 13/42 439/578
2010/0233903 A1 * 9/2010 Islam ..... H01R 24/564 439/578
2011/0021075 A1 * 1/2011 Orner ..... H01R 9/0518 439/585
2011/0254575 A1 10/2011 Uesaka
2012/0171894 A1 * 7/2012 Malloy ..... H01R 13/187 439/578
2013/0023151 A1 * 1/2013 Holliday ..... H01R 9/05 439/578
2013/0065418 A1 * 3/2013 Evans ..... H01R 13/502 439/345

FOREIGN PATENT DOCUMENTS

EP 0348562 A1 1/1990
EP 1309042 A2 5/2003

* cited by examiner

CONTACT ELEMENT WITH RESILIENTLY MOUNTING CONTACT POINTS

BACKGROUND OF THE INVENTION

1. Field of the Invention

The invention relates to a contact element having an outer conductor and a center conductor arranged within the outer conductor, which conductors are each intended to make contact with a component, and in particular a printed circuit board, at end-faces.

2. Description of Related Art

Contact elements may be used to connect (co-axial) conductors in cable form to the appropriate points of contact on a printed circuit board. Such contact elements may also be intended for the electrically conductive connection of two printed circuit boards.

If contact elements of this kind are used as part of a transmission line for radio-frequency signals, there are special requirements that have to be met by the contact made by the outer and center conductors with the points of contact on the printed circuit board.

The center conductor then regularly takes the form of a spring-loaded contact pin, also referred to as a "Pogo pin". A spring-loaded contact pin of this kind comprises a sleeve, and a rod which has a contact-making head and of which a part is guided within the sleeve to be movable. A coil spring which is supported between the rod and the sleeve causes the rod to be spring-loaded to its extended position. The spring-loading causes the contact-making head of the rod always to be in secure contact with the point of contact on the printed circuit board and to be applied with an adequate pressure even when, due to tolerances, there are different distances between the spring-loaded contact pin and said point of contact. The contact-making head is regularly of a hemispherical form, which compensates for deviations by the spring-loaded contact pin, due to tolerances, from a perpendicular alignment with the point of contact, i.e., the area of the contact-making head which makes contact is always of substantially the same size.

The outer conductor, which regularly surrounds the center conductor concentrically, has an annular end-face which in many cases also serves as a contact-making surface. This is a disadvantage particularly when, due to tolerances, the outer conductor is not in exactly perpendicular alignment with the surface for contact on the printed circuit board. A lifting away of the contact-making surface on one side then results in contact with the point of contact still existing over only a comparatively small portion of the end-face of the outer conductor. "Uncontrolled" contact of this kind is undesirable particularly when the contact elements concerned are being used to transmit radio-frequency signals.

SUMMARY OF THE INVENTION

Bearing in mind the problems and deficiencies of the prior art, it is therefore an object of the present invention to provide a contact element having an outer conductor, wherein the outer conductor has, in one of its longitudinally axial end faces, at least one contact point mounted in a spring-like manner for a contact with a contact point on a component part with which contact is to be made.

The above and other objects, which will be apparent to those skilled in the art, are achieved in the present invention which is directed to a contact element including an outer conductor and a center conductor arranged within the outer conductor, the outer conductor having in one of its end-faces along its longitudinal axis at least one point of contact to make contact with a point of contact on a component with which contact is to be made, wherein the point of contact is resiliently mounted such that the end-face is formed by a contact-making ring in the form of a wavy ring which is connected to a body of the outer conductor and is held at the edge between the body and a cap.

The contact-making ring preferably includes resilient tongues. The resilient tongues are preferably formed to extend inwards radially. They may also be formed to extend in arcs around the central axis of the contact-making ring.

The contact-making ring may also be formed from metal felt.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
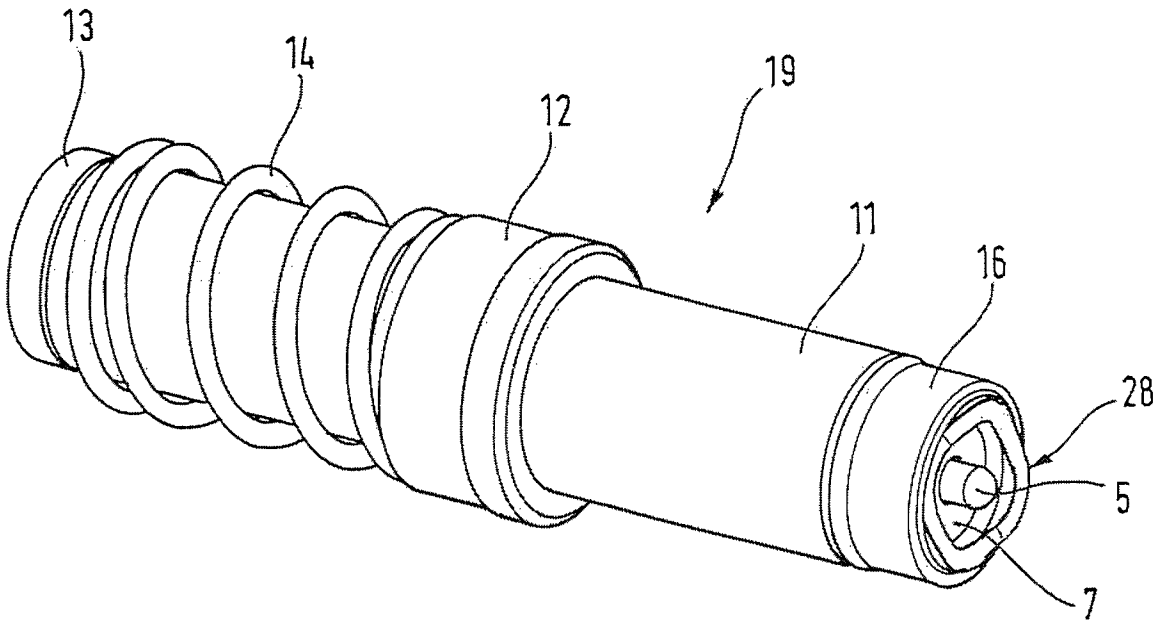
FIG. 1 is a perspective view of a contact element according to the invention.

In describing the preferred embodiment of the present invention, reference will be made herein to FIGS. 1-11 of the drawings in which like numerals refer to like features of the invention.

Taking the above prior art as a point of departure, the object underlying the invention was to specify a contact element of the generic kind which had been improved. In particular, a contact element of the generic kind was to be improved in respect of the contact between the outer conductor and the associated point of contact on the printed circuit board.

This object is achieved by a contact element as defined in the claims. Advantageous embodiments form the subject matter of the claims and can be seen from the following description of the invention.

In a contact element of the generic kind having an outer conductor and a center conductor arranged (preferably coaxially) within the outer conductor, in which contact element the outer conductor has, at (at least) one of its end-faces along its longitudinal axis, (at least) one point of contact to make contact with a point of contact on a component, and in particular a printed circuit board, with which contact is to be made, the invention achieves the stated object by having the point of contact resiliently mounted.

Provision may preferably be made in this case for the end-face of the outer conductor to be formed by a contact-making ring which is connected to the body of the outer conductor. This simplifies the incorporation of mounting the point of contact resiliently, and thus simplifies the production of the contact element according to the invention.

A simple way of achieving a connection of the contact-making ring to the body of the outer conductor is for at least a portion or portions of the contact-making ring to be held at the edge between the body and a cap. The cap can be connected to the body in any desired way in this case such for example as by interference (e.g., as a press fit), by positive inter-engagement (e.g., by a bayonet or threaded joint) and/or by bonding or coalescence (e.g., by soldering, brazing or welding).

In one embodiment, provision may be made for the contact-making ring to take the form of a wavy ring (preferably in the form of a holed disc). A wavy ring of this kind is of an undulating configuration in the circumferential direction, whereby at least one and preferably more than one combination of a hill and a valley is created. The hills for example can then serve as points of contact to make contact with the point of contact on the printed circuit board and the valleys can serve as points of contact which ensure that contact is made with the body of the outer conductor. The wavy ring is preferably formed from a metallic material such as copper for example. It is thereby possible to create, in an inexpensive way, an electrically conducting contact-making ring which is also able to exploit the advantageous elastic properties of its material to allow mounting the point of contact resiliently to be incorporated.

In a further advantageous embodiment, the preferred plurality of resiliently mounted points of contacts on the contact-making ring may be formed by one or more resilient tongues which preferably extend at an inclination towards a central axis of the contact-making ring. The resilient tongues are preferably integrally connected to a main body of the contact-making ring in this case, with a (or at least one) point of contact preferably being provided at the free end of the (and preferably each of the) resilient tongues.

In one embodiment, provision may be made for the resilient tongues to be formed to extend inwards radially. The possibility also exists of the resilient tongues being formed to extend in arcs around the central axis of the contact-making ring.

In an embodiment of contact element according to the invention which is also preferred, provision may be made for the contact-making ring to be formed (at least in part) from metal felt. Metal felt is a three-dimensional structure of fibers intertwined in one another at least some of which consist of electrically conducting material. Elasticity shown by the contact-making ring is then the result of elastic deformation of the fibers in conjunction with relative mobility between them. The points of contact on a contact-making ring of metal felt may be formed by portions of the fibers.

The possibility does of course exist of a contact-making ring of the contact element according to the invention comprising a plurality or all of the embodiments of resiliently mounted points of contact which are described as preferred. For example, a contact-making ring in the form of a wavy ring may in addition be formed to have resilient tongues. Also a wavy ring, possibly having additional resilient tongues, may be combined with a second contact-making ring of metal felt situated below it. A contact-making ring of the contact element according to the invention may thus even be of multi-layered construction.

Figure 2:
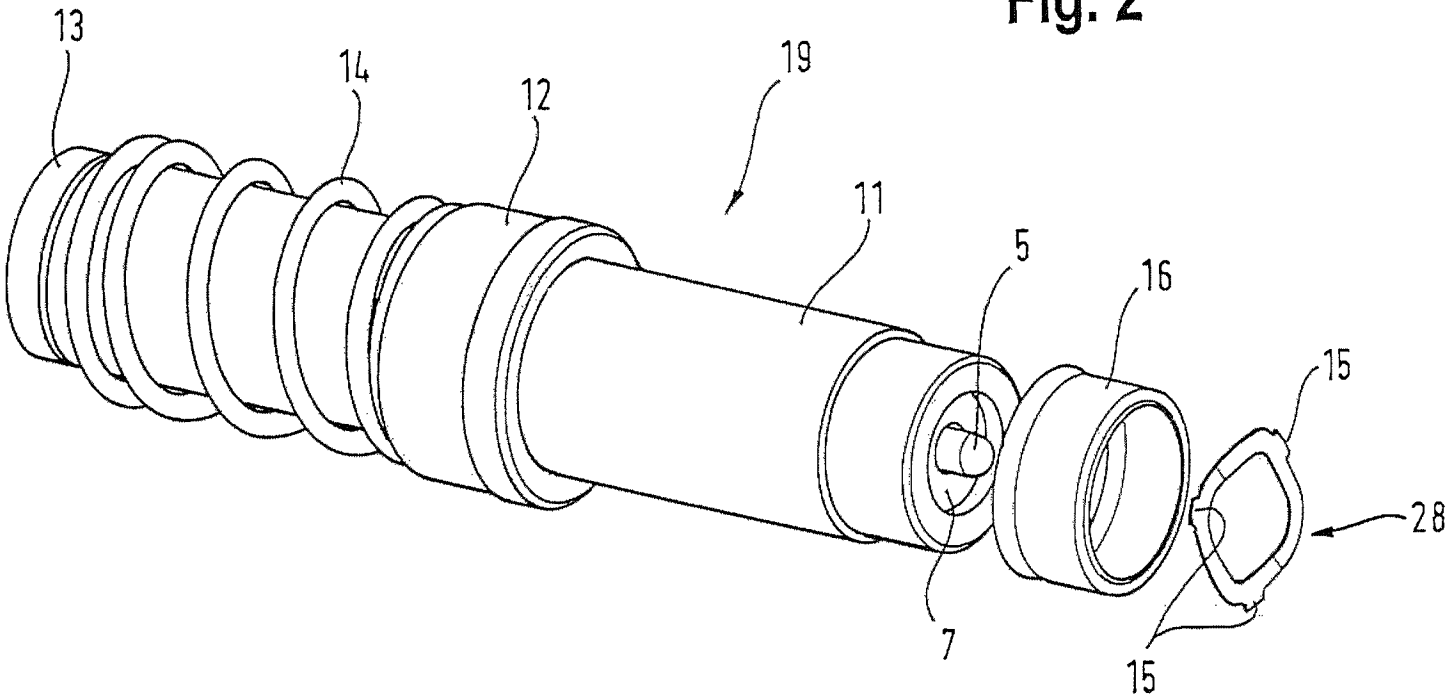
FIG. 2 is an exploded view of the contact element shown in FIG. 1.
Figure 3:
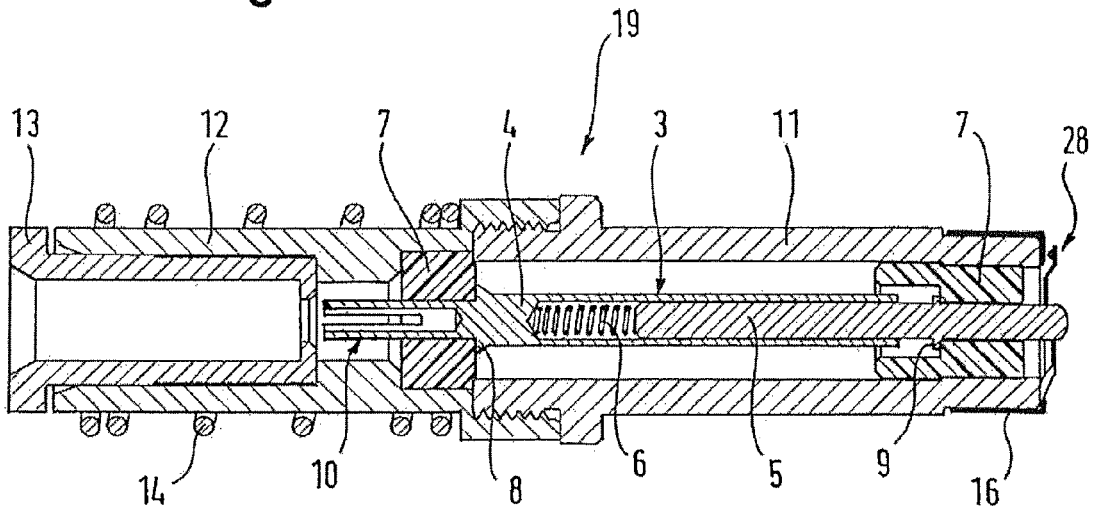
FIG. 3 is a longitudinal section through the contact element shown in FIGS. 1 and 2.

FIGS. 1 to 3 show an embodiment of contact element 19 according to the invention. The purpose is to connect a (co-axial) cable 1 to an associated point of contact on a printed circuit board 2 (see FIGS. 7 to 11). Radio-frequency signals are to be transmitted between the cable 1 and the printed circuit board 2 in this case.

The contact element 19 has a center conductor 3 of electrically conducting material, and in particular of a metal (e.g., copper and/or steel), which center conductor 3 takes the form of a spring-loaded contact pin. The latter comprises a sleeve 4 having a blind hole extending in the direction of its longitudinal axis. Movably mounted in this blind hole is a rod 5, with a contact-making head of the rod 5 projecting beyond the blind hole in the sleeve 4. The rod 5 is resiliently mounted in the sleeve 4 a (coil) spring 6, with a pre-loading of the spring 6 urging the rod 5 towards the open end of the blind hole. The contact-making head of the rod 5 has a curved, and in particular hemispherical, contact-making surface which is intended to make contact with the associated point of contact on the printed circuit board 2.

The center conductor 3 is held in internal holes through two insulating bodies 7 made of electrically insulating material and in particular of plastics material. By an annular shoulder 8 arranged in the vicinity of its cable end, the sleeve 4 is supported in this case against the insulating body 7 arranged at the cable end, while an annular projection 9 on the rod 5 in the vicinity of its contact-making head limits the spring-loaded movement of the rod 5 out of the sleeve 4 as a result of abutment against the insulating body 7 arranged at the cable end.

A connection of the center conductor 3 of the contact element 19 to a center conductor of the associated cable 1 is made via a plug-in connection. For this purpose, the rear end of the sleeve 4 takes the form of a bush 10 having one or more slots extending in the longitudinal direction, into which a male connector on the center conductor of the cable 1 is plugged.

The insulating bodies 7 which receive the center conductor 3 are held in internal holes in an outer conductor. This results in the center conductor 3 and outer conductor being in co-axial positions (on their longitudinal axes). The outer conductor in multi-piece component comprises a first part 11 of its body which is of substantially cylindrical form and which is screwed to a second part 12 of the body which is likewise of substantially cylindrical form. For this purpose, the first part 11 of the body forms an outside thread, which is screwed to an inside thread in the second part 12 of the body.

A solderable bush 13 (made of an electrically conductive material) is inserted in the cable end of the second part 12 of the body and is fixed there by interference. The solderable bush 13 and the second part 12 of the body may be composed of different materials. An outer conductor of the cable 1 which is inserted in the receiving opening in the solderable bush 13 and thus makes an electrically conducting connection is soldered to the solderable bush 13 to fix the cable 1 in position.

The second part 12 of the body is surrounded on the outside by a spring 14 which serves to exactly position the contact element 19 in the connecting device which is shown in FIGS. 7 to 11 and which will be described in detail at a later point.

The front end-face of the outer conductor along its longitudinal axis, which is intended to make contact with the point of contact on the printed circuit board 2, is formed by a contact-making ring 28 in the form of a wavy ring, which is of an undulating configuration in its circumferential direction. There are formed in this case a total of three hills and valleys, with the valleys bearing against the end-face of the first part 11 of the body of the outer conductor whereas the hills, acting as points of contact, are intended to make contact with the point of contact on the printed circuit board 2. In the region of each of the valleys, the contact-making ring 28 also has a tongue 15 which points outwards radially. The tongues 15 are fixed in place, in positive inter-engagement, in a gap which is formed between the first part 11 of the body and a cap 16 that is connected to the latter by interference. The tongues 15 are preferably not clamped to any substantial degree in this case between the first part 11 of the body and the cap 16, thus causing the wavy ring 14 to be rotatably fastened to the body of the outer conductor. If contact is made by the wavy ring 14 with the point of contact on the printed circuit board 2, the wavy ring is deformed to a greater or lesser degree and this, due to the elastic properties of the wavy ring 14, which is formed from copper for example, results in the points of contact in the form of hills becoming spring-loaded. The points of contact can be deformed individually in this case, as a result of which compensation is made for any non-uniform spacing between the point of contact on the printed circuit board and the wavy ring 14, which may be caused in particular by the longitudinal axis of the contact element 19 not being exactly perpendicularly aligned with the point of contact on the printed circuit board 2. In spite of any such misalignment, the spring-loading ensures that all the points of contact on the wavy ring 14 make lasting contact with the associated point of contact on the printed circuit board 2.

Figure 4:
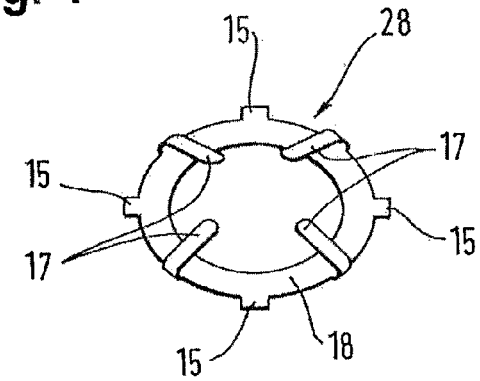
FIG. 4 shows a first embodiment of contact-making ring for use with the contact element shown in FIGS. 1 to 3.
Figure 5:
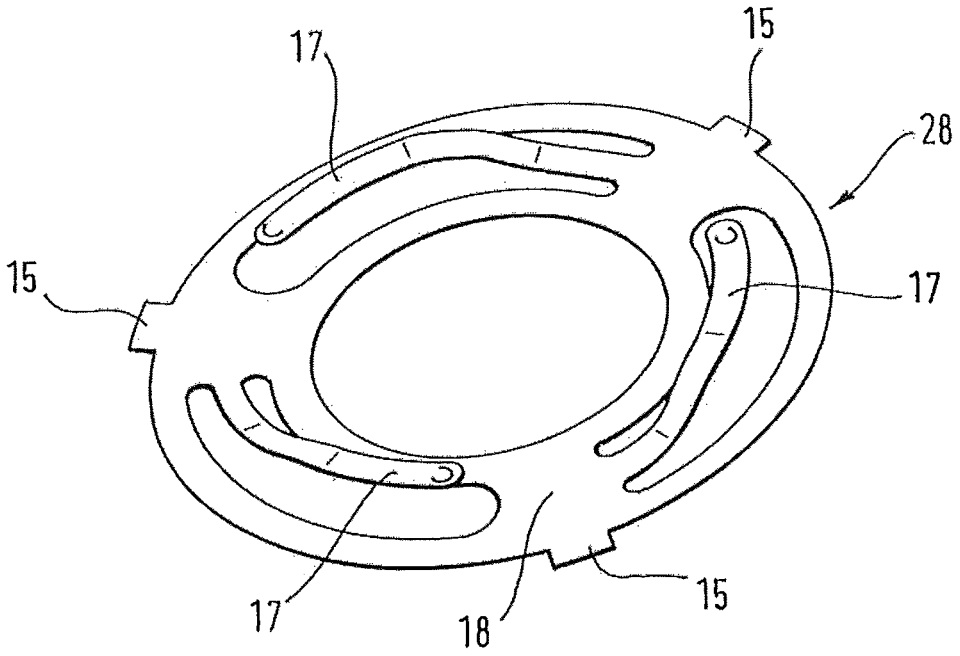
FIG. 5 shows a second embodiment of contact-making ring for use with the contact element shown in FIGS. 1 to 3.
Figure 6:
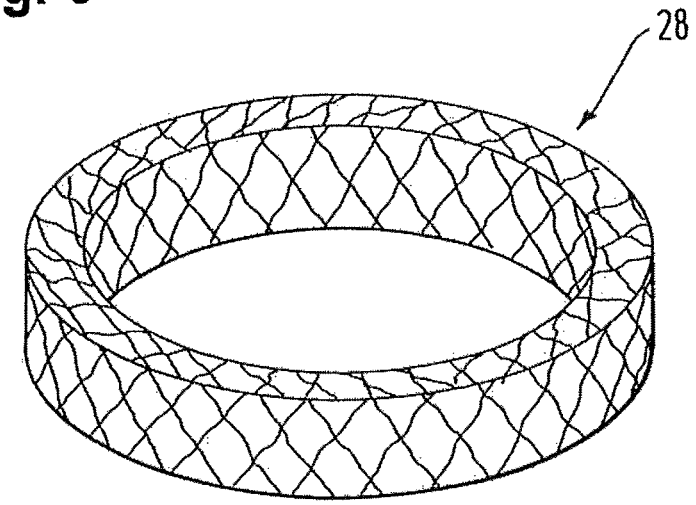
FIG. 6 shows a third embodiment of contact-making ring for use with a contact element as shown in FIGS. 1 to 3.
Figure 7:
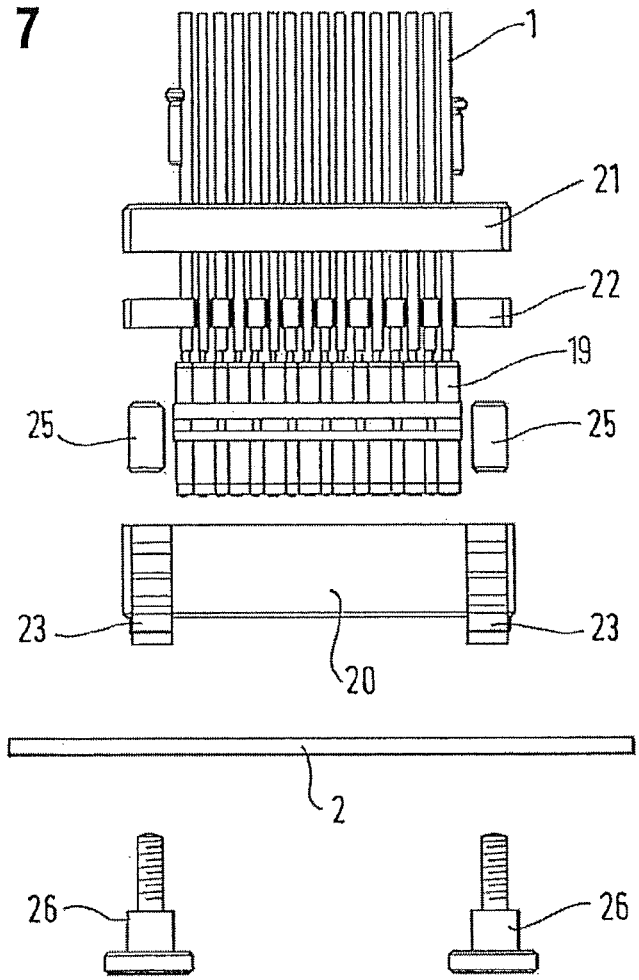
FIG. 7 is an exploded view of a system comprising a connecting device for a plurality of contact elements as shown in FIGS. 1 to 3 plus a printed circuit board.
Figure 8:
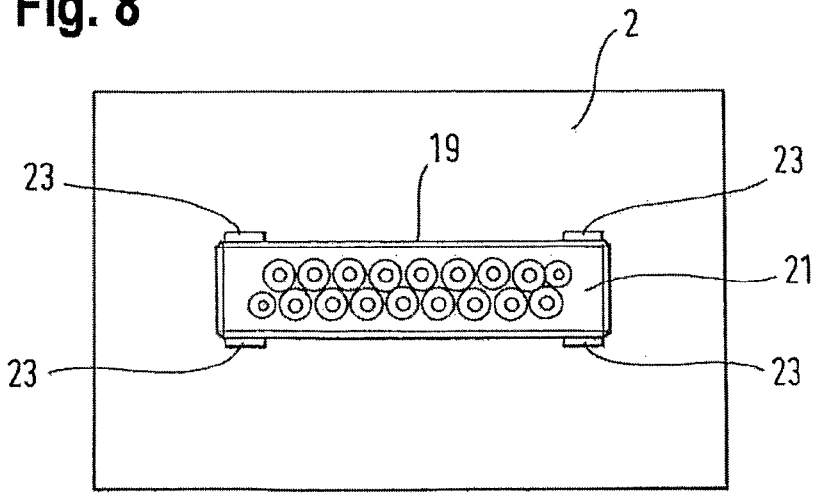
FIG. 8 is a plan view of the system shown in FIG. 7.
Figure 9:
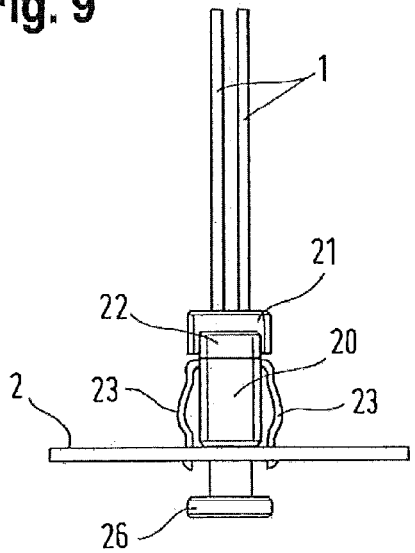
FIG. 9 is a view from the side of the system shown in FIGS. 7 and 8.
Figure 10:
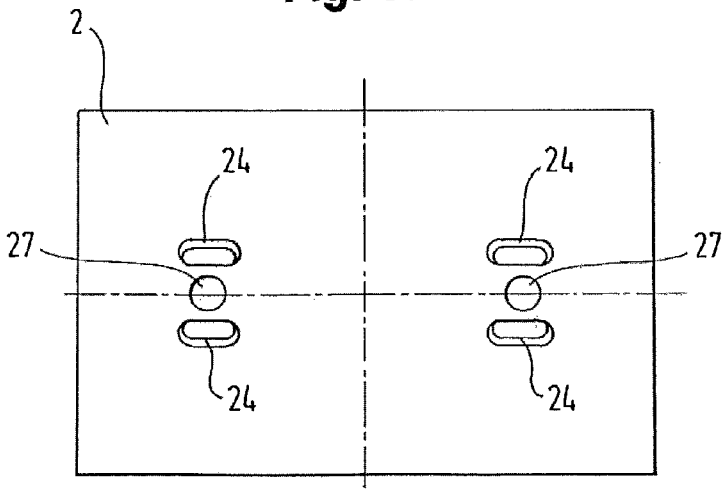
FIG. 10 is a view from below of the printed circuit board of the system shown in FIGS. 7 to 9.

FIGS. 4 to 6 show alternative embodiments of contact-making rings 28 which, in the case of the contact element 19 shown in FIGS. 1 to 3, can be used in place of the wavy ring 14.

In the case of the contact-making rings 28 shown in FIGS. 4 and 5, the points of contact are formed by resilient tongues 17 which are integrally formed with a plane, annular, main body 18 of the contact-making ring 28. The contact-making tongues 17, which point inwards radially in the embodiment shown in FIG. 4 and which are arranged in arcs around the central axis of the contact-making ring 28 in the embodiment shown in FIG. 5, are arranged in this case to extend with a slight inclination towards the central axis. As a result, the points of contact formed by the resilient tongues 17 are at a defined distance from the main body 18 (in the direction defined by the longitudinal axis of the contact element 19). When in contact with the point of contact on the printed circuit board 2, they are thus able to yield individually under spring-loading in the direction of the cable end of the contact element 19. This enables compensation to be made for any non-uniform spacing of the point of contact on the printed circuit board 2 from the main body 18 of the contact-making ring 28, due in particular to not being aligned exactly parallel to one another. In spite of any such misalignment, the spring-loading ensures that all the points of contact on the contact element 19 make lasting contact with the associated point of contact on the printed circuit board 2.

In the embodiment shown in FIG. 6, the contact-making ring 28 is formed from metal felt, i.e., it comprises a large number of metal fibers (wires) which are randomly intertwined in one another. A plurality of the fibers form one or more points of contact which, due to an elastic deformation of the individual fibers and relative movement of the fibers amongst themselves, are able to yield elastically if contact is made with the point of contact on the printed circuit board 2. This embodiment of contact-making ring 28 too makes lasting contact possible and thus makes reliable transmission of the radio-frequency signals possible between the cable 1 and the printed circuit board 2.

FIGS. 7 to 11 show a connecting device in which a plurality of contact elements 19, such as are shown in FIGS. 1 to 3 for example, can be connected to the printed circuit board 2.

The connecting device comprises a housing having a lower part 20 and an upper part 21. The lower part 20 of the housing has a number of through-openings corresponding to the number of contact elements 19, in each of which through-openings a contact element 19 is inserted. In the region of that outer face of the lower part 20 of the housing which is directly adjacent the printed circuit board 2 (this face being at the end for contact-making), there is provided within each of the through-openings an annular shoulder which reduces the diameter of the through-opening. It is against these shoulders that the contact-making ends of the contact elements 19 received in the through-openings are supported. The diameter created for the through-openings by the shoulders is sufficiently large in this case for the points of contact which are formed on the outer conductors of the contact elements 19 at their end-faces to project through and hence to project beyond the lower part of the housing.

The upper part 21 of the housing surrounds the cable ends of the contact elements 19. Arranged inside the upper part 21 of the housing is a mating support 22 which is of substantially the same outside dimensions as the lower part 20 of the housing and which also has, likewise, a plurality of through-openings in each of which the cable end of the outer conductor of one of the contact elements 19 is inserted. The diameter of the through-openings is only slightly larger in this case than the outside diameter of the cable ends of the contact elements 19, whereby the cable ends of the springs 14, which springs 14 are inserted onto the second parts 12 of the bodies of the outer conductors of the contact elements 19, are supported against the mating support 22. In conjunction with the support which the springs 19 have at the front against an annular shoulder on the second part 12 of the body of the outer conductor of the contact elements 19, there can thereby be obtained when the connecting device is in the assembled state a spring-loading by which the contact elements 19 are pressed against the shoulders in the through-openings in the lower part 21 of the housing. This ensures good contact by the points of contact on the outer conductors of the contact elements 19 with the associated points of contact on the printed circuit board 2.

A connection between the lower part 20 of the housing, the mating support 22 and the upper part 21 of the housing can be made in any desired way. A releasable connection is desired and preferred, which can be formed by a latched connection for example.

Fastened to each of the longitudinal sides of the lower part 20 of the housing are two tongues for latching 23 of an elastic and preferably metallic material (e.g., steel). The tongues for latching 23 project beyond the end for contact-making of the lower part 20 of the housing, and thus project into through-openings 24 in the printed circuit board 2. Each of the tongues for latching 24 forms at least one projection which fits behind the edge of the associated through-opening 24 in the printed circuit board 2, whereby a latched connection is made between the connecting device and the printed circuit board 2.

Figure 11:
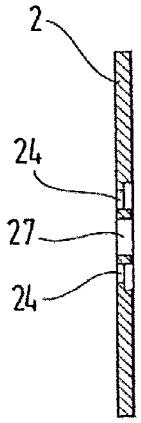
FIG. 11 is a cross-section through the printed circuit board shown in FIG. 10.

As can be seen from FIG. 11 in particular, the through-openings 24 in the printed circuit board 2 are of a stepped form. Each of the steps (two are shown but more than two may advantageously be provided) forms an edge behind which the projection on the associated tongue for latching 23 of the connecting device is able to fit. The steps in the through-openings 24, which differ in their distance from the surface situated on the side for contact of the printed circuit board 2, enable the connecting device to be connected easily and securely to the printed circuit board 2 even when there are comparatively large differences in dimensions, due to tolerances, particularly between the component parts of the connecting device.

The lower part 20 of the housing of the connecting device also has two additional through-openings, which are arranged next to the through-openings for the contact elements 19 and which—like the latter—have at the end for contact-making of the lower part 20 of the housing an annular shoulder to reduce their diameter. These two through-openings each receive a threaded sleeve 25 which is preferably formed from metal. The outside thread on a fastening screw 26 can be screwed into each of these threaded sleeves 25 (which have inside threads). The fastening screws 26 then project through additional through-openings 27 in the printed circuit board 2 and are supported against the opposite side of the printed circuit board 2 from the side for contact. This provides the option of screwing the connecting device to the printed circuit board 2, particularly when there are special requirements for lastingly secure fastening. The heads of the fastening screws are of relatively large diameter and—as an option—are provided at the edges with knurling which makes it possible for the screwed connection to be tightened and released manually.

The sizes of the components of the connecting device and of the printed circuit board 2 and the design of the springs constants of the springs 6, 14 and of the resiliently acting contact-making rings 28 of the contact elements 19 are preferably selected in such a way that the end for contact-making of the lower part 20 of the housing of the connecting device does not rest directly against the adjoining surface of the printed circuit board 2; instead, a small gap should be left. Otherwise, the fact of the lower part 20 of the housing resting against the printed circuit board 2 might hamper the center and/or outer conductor (or in other words the points of contact formed by the contact-making rings 28) of individual ones, or all, of the contact elements 19 from making defined spring-loaded contact.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A contact element including an outer conductor and a center conductor arranged within the outer conductor, the outer conductor having its front end-face along its longitudinal axis at least one first point of contact to make contact with a second point of contact on a printed circuit board with which contact is to be made, wherein the first point of contact is resiliently mounted such that the end-face is formed by a contact-making ring in the form of a wavy ring which is rotatably connected to a body of the outer conductor and is held at the edge in a gap which is formed between the body and a cap which is connected to the body by at least one of interference, positive inter-engagement, and bonding or coalescence.

2. The contact element of claim 1, wherein the contact-making ring includes resilient tongues.

3. The contact element of claim 2, wherein the resilient tongues are formed to extend inwards radially.

4. The contact element of claim 2, wherein the resilient tongues are formed to extend in arcs around the central axis of the contact-making ring.

5. The contact element of claim 1 wherein said wavy ring comprises an undulating configuration in a circumferential direction formed by a plurality of peaks and troughs.

6. A contact element including an outer conductor and a center conductor arranged within the outer conductor, the outer conductor having at its front end-face along its longitudinal axis at least one first point of contact to make contact with a second point of contact on a printed circuit board with which contact is to be made, wherein the at least one first point of contact is resiliently mounted such that the end-face is formed by a contact-making ring in the form of a wavy ring which is rotatably mounted to a body of the outer conductor and is held at the edge in a gap which is formed between the body and a cap which is connected to the body by at least one of interference, positive inter-engagement, and bonding or coalescence.

7. The contact element of claim 6 wherein said at least one point of contact is provided in the form of a peak or hill of said wavy ring, such that said wavy ring becomes spring loaded, providing a resilient spring force, when contact is made therewith.

* * * * *